United States Patent [19]

Fujita

[11] Patent Number: 5,016,403

[45] Date of Patent: May 21, 1991

[54] ELECTRICALLY-OPERATED FOLDING STAGE SYSTEM

[76] Inventor: Kazuo Fujita, No. 1, Hagiyamada 1-chome, Seto-shi, Aichi-ken, Japan

[21] Appl. No.: 465,326

[22] Filed: Jan. 16, 1990

[51] Int. Cl.[5] ..... E04H 3/28

[52] U.S. Cl. ..... 52/7; 52/645; 52/64; 52/69; 52/71; 182/223

[58] Field of Search ..... 52/7, 6, 64, 69, 71, 52/645; 108/112; 182/223, 152

[56] References Cited

U.S. PATENT DOCUMENTS

| | | | |
|---|---|---|---|
| 4,872,295 | 10/1989 | Fujita | 52/7 |
| 4,939,875 | 7/1990 | Fujita | 52/7 |

FOREIGN PATENT DOCUMENTS

| | | |
|---|---|---|
| 45-30907 | 10/1970 | Japan . |
| 58-47656 | 3/1983 | Japan . |
| 58-91962 | 6/1983 | Japan . |
| 60-25482 | 7/1985 | Japan . |
| 61-16200 | 1/1986 | Japan . |
| 62-190059 | 12/1987 | Japan . |
| 62-194865 | 12/1987 | Japan . |
| 62-199460 | 12/1987 | Japan . |
| 1-105875 | 4/1989 | Japan . |
| 1-187268 | 7/1989 | Japan . |

*Primary Examiner*—James L. Ridgill, Jr.

*Attorney, Agent, or Firm*—Fred Philpitt

[57] ABSTRACT

Electrically-operated Folding Stage System An electrically-operated folding stage system comprises a pair of first and second stage components connected to each other and each including a platform, plural operating means each having a pair of output shafts and located directly below a borderline between the platforms of the stage components, a first link means with a lower end fixed to one of the output shafts, a second link means with a lower end fixed to the other output shaft, means for pivotally connecting an upper end of the first link means to a bottom of the platform of the first stage component, and means for pivotally connecting an upper end of the second link means to the bottom of the platform of the second stage component. The platforms of the first and second stage components provide a single continuous surface when the first and second stage components are in horizontal positions on a floor. When the operating means are operated, the first link means arcs toward the second stage component to move the first stage component from the horizontal position to a first vertical position while the second link means arcs toward the first stage component to move the second stage component from the horizontal position to a second vertical position which faces the first vertical position.

14 Claims, 7 Drawing Sheets

ELECTRICALLY-OPERATED FOLDING STAGE SYSTEM

FIELD OF THE INVENTION

This invention relates to electrically-operated folding stage systems

BACKGROUND OF THE INVENTION

Prior to producing this invention, the inventor proposed two different types of stage systems, namely a high-type one and a low-type one in Japanese Application for Registration of Utility Model No. 59-100829 (published under No. 61-16200). Either of the high-type and low-type stage systems has a guide post to be fixed to a wall or the like, and a balancer mechanism supporting the rear portion of the stage body for vertical movement. Also, either type of system has, on its front portion, wheels to enable the stage body to be moved on a floor. The stage body of either type of system can be displaced or stored from a horizontal position on the floor to a vertical position adjacent to the post. The high-type system includes legs pivotally connected to the bottom of a platform so that the legs make right angles with the platform when supporting the platform on the floor, but change their angles to the platform as the legs are raised away from the floor when the stage body is removed to the vertical position, and become parallel to the platform when the platform is removed to a vertical position. On the other hand, the low-type system includes legs fixed to the bottom of a platform.

However, either type of system may be used only in a place inside or outside a building where its guide post can be fixed to a wall or the like. Also, the stage body cannot have a depth greater than the height of the post. In other words, the depth of the stage body is limited by the height of the post. Therefore, if either type of system is manufactured for use in a place with a floor-to-ceiling height of only 3 to 4 meters, such as a schoolroom, a recreation room or an assembly room of a school or a kindergarten or in an assembly room, a council room or a grand hall of a hotel or the like, the system cannot have a stage body having a depth of more than 3 to 4 meters. Thus it may further be said that the depth of the stage body is limited by the height from the floor to the ceiling.

A stage system similar to the foregoing ones was also proposed in Japanese Application for Registration of Utility Model No. 52-82315 (published under No. 60-25482) filed in the name of the inventor hereof.

Also, a folding stage system was proposed in Japanese Patent Application No. 41-44861 (published under No. 45-30907 and corresponding to U. S. Patent application Ser. No. 509138 filed Nov. 22, 1965). This stage system includes a pair of stage components connected to each other so that the components can be displaced from horizontal positions to opposed vertical positions. Thus, if the stage system is used in a room having a floor-to-ceiling height slightly greater than the "folded height" of the system, the system may be so unfolded as to have a depth much greater than the floor-to-ceiling height. That is, the depth of the system is not limited by the floor-to-ceiling height. Also, if a plurality of such stage systems are arranged on a floor in such a manner that the systems make contact with one another, a stage with a desired area may be obtained.

However, the foregoing stage system of the Application No. 41-44861 must be manually folded or unfolded.

In other words, its two stage components must be manually displaced from their horizontal positions to their vertical positions or vice versa. Therefore, the stage components each must be one having such a weight or size that the user or operator can manually displace the component. Also, if a plurality of the stage systems are to be arranged on a floor to provide a stage with a desired area, each system must be manually carried or moved to the required position. Also, since the two stage components of the system are displaced with distal side portions of the components upwardly arcing, additional stage systems cannot be connected to the distal side portions of the system components to provide a larger stage system.

In order to solve the foregoing problems of the prior art the inventor hereof proposed novel electrically-operated stage systems in Japanese Patent Applications Nos. 63-9407 and 63-72712, now U.S. Pat. No. 4,872,295 issued Oct. 10, 1989.

SUMMARY OF THE INVENTION

The inventor hereof proposes electrically-operated stage systems similar to the stage systems of Japanese Patent Applications Nos. 63-9407 and 63-72712, but substantially different therefrom in that in the invention hereof operating means are located directly below the borderline between two stage components and in that link means are provided to connect output shafts of the operating means and the stage components.

It is an object of the invention to provide a folding stage system which may be used in a desired place inside or outside a building.

Another object of the invention is to provide a folding stage system which is automatically folded or unfolded.

A still another object of the invention is to provide an electrically-operated folding stage system.

A further object of the invention is to provide a folding stage system whose depth when the system is unfolded is not limited by the floor-to-ceiling height of a room where the system is used.

A still further object of the invention is to provide a folding stage system which provides a relatively great stage area.

The fundamental construction of the stage system of the invention comprises a pair of first and second stage components connected to each other and each including a platform, plural operating means each having a pair of output shafts and located directly below a borderline between the platforms of the stage components, a first link means with a lower end fixed to one of the output shafts, a second link means with a lower end fixed to the other output shaft, means for pivotally connecting an upper end of the first link means to a bottom of the platform of the first stage component, means for pivotally connecting an upper end of the second link means to the bottom of the platform of the second stage component. The platforms of the first and second stage components provide a single continuous surface when the first and second stage components are in horizontal positions on a floor. When the operating means are operated, the first link means arcs toward the second stage component to move the first stage component from the horizontal position to a first vertical position while the second link means arcs toward the first stage component to move the second stage component from the horizontal position to a second vertical position which faces the first vertical position.

According to a preferred embodiment of the invention, means may be provided for allowing the operating means to be moved at least in two opposite directions on the floor.

According to one aspect of the invention, each link means may include a pair of integrally formed tubes and a pair of rods slidably disposed in the respective tubes so that the rods may be extended from the respective tubes or retracted thereinto as the stage system is unfolded and unfolded, thereby changing the distance between the output shaft to which the lower end of the link means is fixed and the means for pivotally connecting the upper end of the link means to the platform.

According to another aspect of the invention, each link means may include no extensible member. In this case the foregoing distance is not changed.

According to one embodiment of the invention, a high-type electrically-operated folding stage system may include a first and second stage components each having plural rows of brackets fixed to the bottom of a platform thereof, legs pivotally connected to the respective brackets at upper ends thereof, a beam located in parallel with an outer row of the legs and extending along a line connecting lower ends of the legs of the outer row, a beam located in parallel with an opposed outer row of the legs and extending along a line connecting lower ends of the legs of the opposed outer row, a pair of beams located in parallel with a central row of the legs on opposed sides of the central row of the legs and extending along a line connecting lower ends of the legs of the central row, and rods arranged in directions perpendicular to the beams and each extending through corresponding legs of the rows of the legs and the beams. The beams are capable of turning on the rods. The high-type folding stage system may further include means connected to the lower ends of foremost legs of the first stage component and to the lower ends of rearmost legs of the second stage component for allowing the stage components to be moved at least in two opposite directions on a floor. Alternatively, only the foremost legs of the first stage component may be made movable at least in two opposite directions on the floor, and the lower ends of the rearmost legs of the second stage component may be fixed on the floor.

According to another embodiment of the invention, a low-type electrically-operated folding stage system may include a first and second stage components each having plural legs fixed to a bottom of a platform thereof. The low-type stage system may further include means connected to the lower ends of foremost legs of the first stage component and to the lower ends of rearmost legs of the second stage component for allowing the stage components to be moved at least in two opposite directions. Alternatively, only the foremost legs of the first stage component may be made movable at least in two opposite directions, and the lower ends of the rearmost legs of the second stage component may be pivotally connected to fixing means which are secured on the floor.

BRIEF DESCRIPTION OF THE DRAWING

FIG. 5(*b*) shows another connecting means which may be used to connect the first and second stage components of the stage system of FIG. 1;

FIG. 6(*b*) shows a wheel which may be connected to the lower end of each foremost leg of the first stage component of the stage system of FIG. 1 or 4 or to the lower end of each rearmost leg of the second stage component thereof;

FIG. 8(*b*) shows means which may be used to fix the rearmost leg of the second stage component of the stage system of FIG. 4 on a floor.

DETAILED DESCRIPTION OF THE PREFERRED EMBODIMENTS

According to the invention, two different types of electrically-operated folding stage systems, namely, a high-type one and a low-type one may be provided.

High-type Stage System

Figure 1:
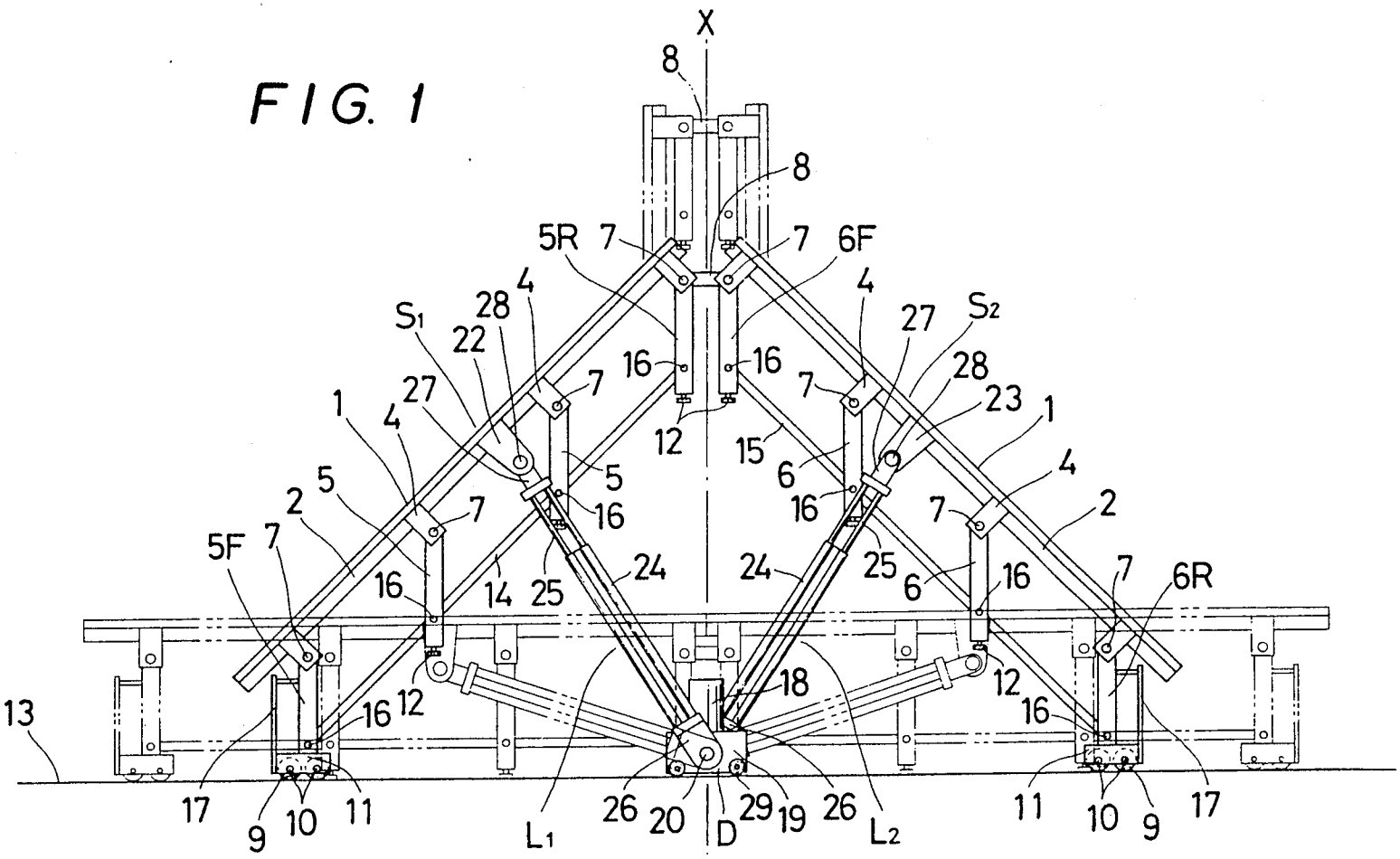
FIG. 1 is a side view of a high-type electrically-operated folding stage system according to the invention.
Figure 2:
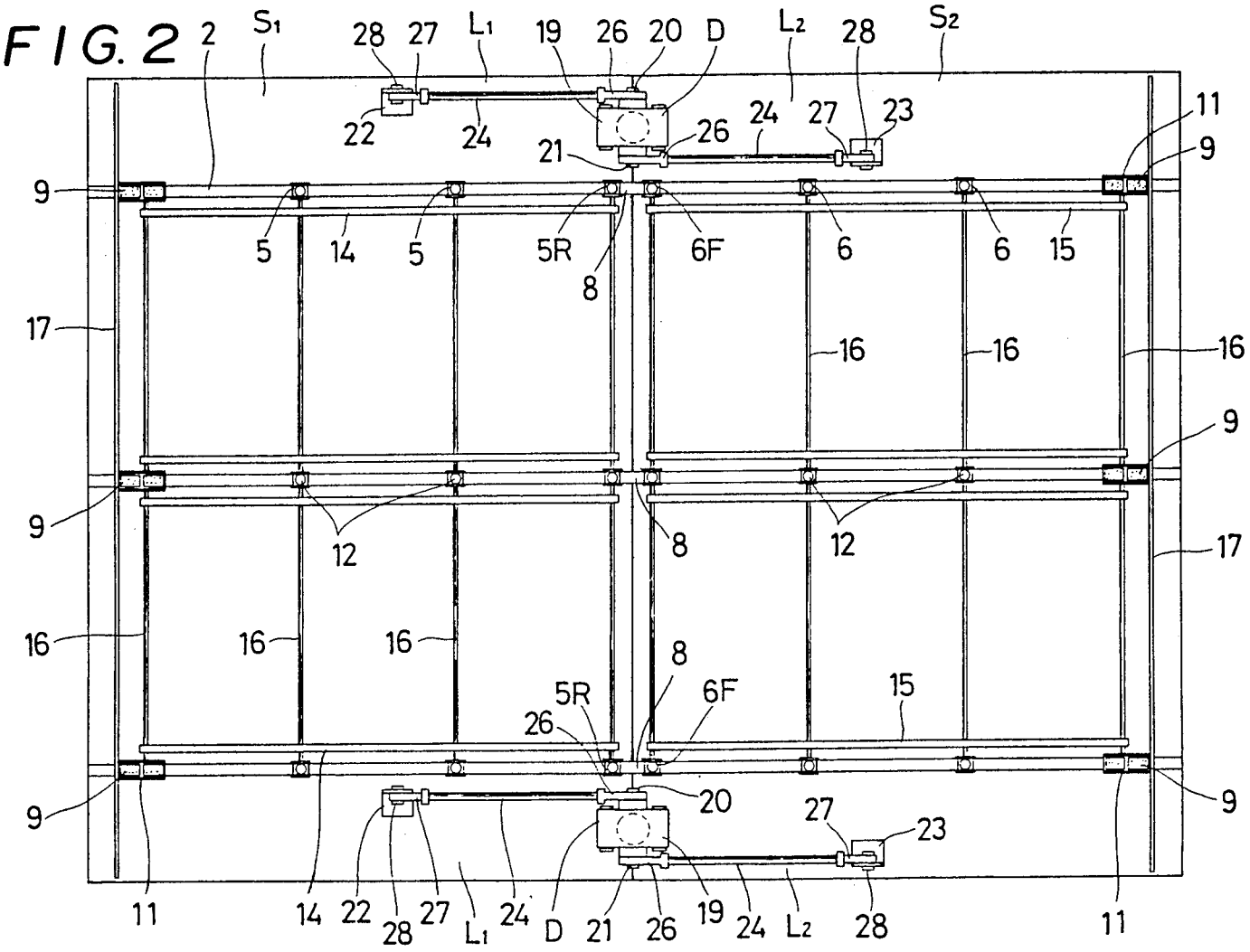
FIG. 2 is a bottom view of the stage system of FIG. 1.

FIGS. 1 and 2 depict a high-type electrically-operated folding stage system which embodies the invention in one preferred form. The stage system of FIGS. 1 and 2 includes a pair of first and second stage components $S_1$ and $S_2$. The components $S_1$ and $S_2$ provide a stage when they are in their horizontal positions as shown in phantom, and are collapsible or foldable to a vertical position as also shown in phantom. The first or second stage component may be used as the front stage.

Each stage component includes a platform 1. The platforms of the stage components form a single continuous horizontal surface when the stage system is unfolded. Plural beams 2 may be secured to the underside of the platform 1. In the illustrated embodiment the beams 2 are three in number. The beams 2 are parallel to one another, and extend from the front side to the rear side of the platform 1. Plural brackets 4 may be fixed to each beam 2. In the illustrated embodiment four brackets are fixed to each beam 2. The brackets 4 are equally spaced apart from one another. An upright leg 5 (or 6) is pivotally connected to the lower end of each bracket 4 by means of a pin 7. The legs 5 (or 6) connected to the brackets 4 fixed to one beam 2 form a row of legs. Each leg of each row forms a rank of legs together with the corresponding legs of the other rows.

All the sides of the platform 1 of each stage component other than the side thereof adjacent to the platform of the other stage component, together with the beams 2, may be covered with a suitable means (not shown) to keep them from sight.

An interconnecting means 8 is fixed to the upper end of the rearmost leg 5R of each row of the legs 5 of the first stage component $S_1$ and to the upper end of the foremost leg 6F of the opposed row of the legs 6 of the second stage component $S_2$ (FIG. 5*a*). The interconnecting means 8 thus connects the two stage components. Wheel enclosures 11 are secured to the lower ends of the foremost legs 5F of the first stage component and to the lower ends of the rearmost legs 6R of the second stage component. A pair of wheels 9 are provided in each enclosure 11. The greater part of each wheel 9 is covered by the enclosure 11. The wheels 9 rotate on shafts 10. When the stage system is folded or unfolded, the wheels 9 rotate to facilitate the movement of the stage components. Auxiliary legs 12 are connected to the bottoms of all the legs of the stage components other than the foremost legs 5F of the first stage component and the rearmost legs 6R of the second stage component. The auxiliary leg 12 have such heights that, when the auxiliary legs 12 are on a floor 13, the associated legs 6 have the same heights from the floor as the foremost legs of the first stage component and the rearmost legs of the second stage component. Thus, when the stage system is in the state of being unfolded, the platforms of the two stage components are on the same level.

A beam 14 (or 15) is provided inside the legs of each outer row, and extends along the lower end portions of the legs. A pair of opposed beams 14 (or 15) are provided on the opposed sides of the legs of the middle row, and extend along the lower end portions of the legs. Rods 16 are located at right angles to the beams 14 (or 15). Each rod 16 extends through the lower portions of the legs of one rank and the portions of the beams 14 (or 15) adjacent to the lower portions of the legs. The beams 14 (or 15) may turn on the rods 16.

The foregoing arrangement allows all the legs 5 (or 6) to be in upright positions at all times.

An elongate plate 17 is located below the front end portion of the platform 1 of the first stage component. Similarly, an elongate plate 17 is located below the rear end portion of the platform 1 of the second stage component. The plates 17 serve to keep the construction below the platforms from the view of an audience.

The stage components are moved by a pair of operating means D which are opposed to each other with the foregoing framework structure between. Each operating means D includes an electric motor 18 and a speed reducer 19. The speed reducer 19 is provided with wheels 29 to enable the operating means D to move smoothly on the floor. As illustrated in FIG. 2, the operating means D are located directly below the borderline between the first and second stage components, as indicated by a vertical line X. The speed reducer 19 has a pair of output shafts 20 and 21 projecting outwardly in opposite directions. Each output shaft is rotatable in either direction. Each output shaft has a torque limiter (not shown) therein.

A first link means $L_1$ is provided to move the first stage component, while a second link means $L_2$ is provided to move the second stage component. Each link means comprises an elongate member 24 and a pair of rods 25. The elongate member 24 includes a pair of integrally formed tubes. Also, the elongate member 24 has a lower end portion 26 fixed to the output shaft 20 (or 21). The rods 25 are slidably disposed in the respective tubes and, hence, may be extended and retracted from and into the tubes. A pair of opposed support means 22 are fixed to the bottom of the platform 1 of the first stage component with the framework structure thereof between. The support means 22 are located a little to the right of the center of gravity of the first stage component $S_1$ (in FIG. 1). Also, a pair of opposed support means 23 are fixed to the bottom of the platform 1 of the second stage component with the framework structure thereof between. The support means 23 are located a little to the left of the center of gravity of the second stage component $S_2$ (in FIG. 1). An upper end 27 of the first link means $L_1$ is connected to one of the support means 22 by a pivotal pin 28. Similarly, an upper end 27 of the second link means $L_2$ is connected to one of the support means 23 by a pivotal pin 28.

Folding of the Stage System

When the stage system is to be folded from a horizontal position as shown in phantom in FIG. 1 to a vertical position as also shown in phantom in FIG. 1, the two opposed operating means D (motors 18 and speed reducers 19) are simultaneously operated to rotate the outer output shafts 20 and the inner output shafts of the speed reducers 19 clockwise and counterclockwise, respectively, at a very low speed, e.g., at a reduction ratio of 1:24,000. Since, as mentioned above, the support means 22 of the first stage component is located a little to the right of the center of gravity of the first stage component (in FIG. 1), the link means $L_1$ causes the right-hand end portion (in FIG. 1) of the first stage component to move upward. Thus, the link means $L_1$ moves the first stage component to a vertical position while making an arcing motion in a clockwise direction (in FIG. 1). Concomitantly, the rods 25 are extended from the elongate member 24. Simultaneously, since, as mentioned above, the support means 23 of the second stage component is located a little to the left of the center of gravity of the second stage component (in FIG. 1), the link means $L_2$ causes the left-hand end portion (in FIG. 1) of the second stage component to move upward. Thus, the link means $L_2$ moves the second stage component to a vertical position while making an arcing motion in a counterclockwise direction (in FIG. 1). Concomitantly, the rods 25 are extended from the elongate member 24. It means that, as the stage components are moved to the vertical positions, the distance between the output shaft 20 (or 21) and the pivotal pin 28 associated therewith is increased.

The stage system is thus folded to a vertical position.

When the stage system is thus folded, the wheels 9 thereof move toward each other to facilitate the folding thereof. Also, when the stage system is thus folded, all the legs 5 and 6 move toward each other while maintaining their upright positions.

When the stage system is to be stored, it may be safer to half fold the stage system, i.e., fold it until it assumes such a posture as shown in FIG. 1, in the site where the stage system has been used, move the half-folded stage system to the place where it is to be stored and fold it to a vertical position there than to move it to the storage place after completely folding it in the site. The operation of storing the stage system may be made more safely if the foremost legs 5F or the rearmost legs 6R of the half-folded stage component are connected to a wall before completely folding the stage system in the storage place.

Unfolding of the Stage System

When the stage system is be unfolded from its vertical position to its horizontal position, the output shafts 20 and 21 are simultaneously rotated in directions opposite to the directions in which the output shafts 20 and 21 are rotated to fold the stage system. Thus, each link means $L_1$ makes an arcing motion in a counterclockwise direction, while each link means $L_2$ makes an arcing motion in a clockwise direction. Hence, the upper end portions of the stage components move downward while the wheels 9 of the two stage components move away from each other. The stage components thus move to horizontal positions. The stage system is unfolded to its horizontal position in this manner. When the stage system is thus unfolded, the legs 5 and 6 maintain their upright positions. Also, while the stage system is thus unfolded, the rods 25 are retracted into the elongate members 24. It means that, as the stage system is unfolded, the distance between the output shaft 20 (or 21) and the pivotal pin 28 associated therewith is reduced.

When the stage system is to be unfolded, it may be safer to half unfold the stage system, i.e., unfold it until it assumes such a posture as shown in FIG. 1, in the place where the stage system has been stored, move the half-unfolded stage system to the place where it is to be used and unfold it to a horizontal position there than to completely unfold it in the place where it has been stored before moving it to the place where it is to be used.

Variations of Interconnecting Means

Figure 5:
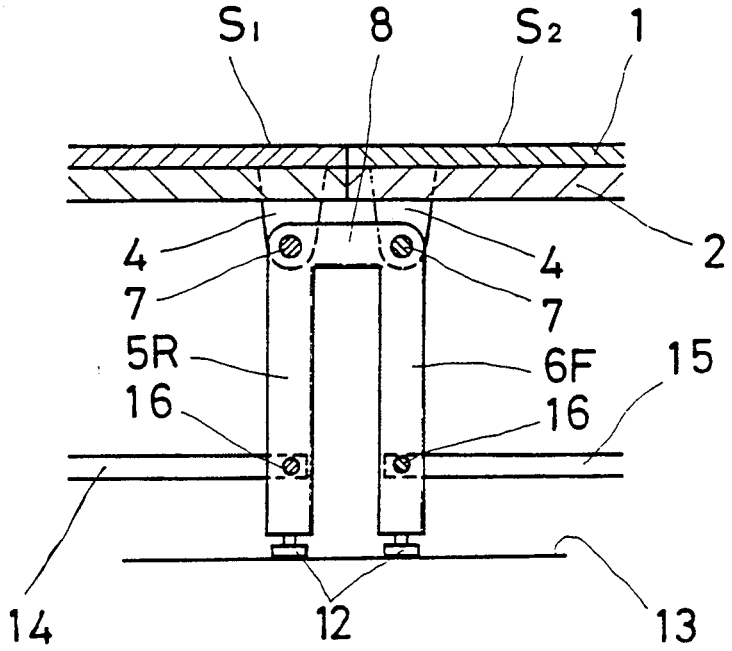
FIG. 5(*a*) shows connecting means which may be used to connect first and second stage components of the stage system of FIG. 1.
Figure 5:
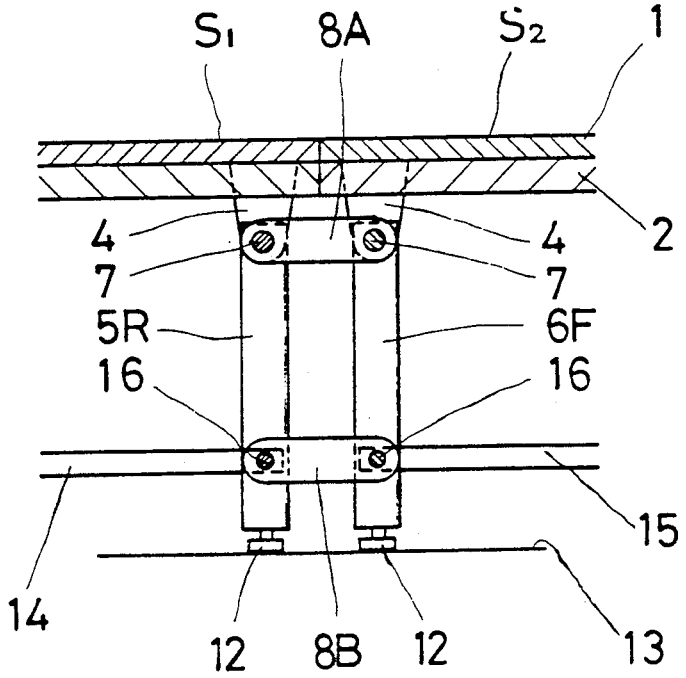

In the embodiment of FIGS. 1 and 2 the stage components are connected by means of the interconnecting means 8 fixed to the upper end of the rearmost leg 5R of each row of the legs 5 of the first stage component $S_1$ and to the upper end of the foremost leg 6F of the opposed row of the legs 6 of the second stage component $S_2$. FIG. 5(*a*) depicts the interconnecting means 8 in detail. If desired, however, two links may be used instead of the interconnecting means 8 as shown in FIG. 5(*b*). That is, as shown in FIG. 5(*b*), an upper link 8A may be mounted on the rearmost pivotal pin 7 of the first stage component and on the foremost pivotal pin 7 of the second stage component, and a lower link 8B may be mounted on the rearmost pivotal rod 16 of the first stage component and on the foremost pivotal rod 16 of the second stage component. The lower link 8B is mounted in a position directly below the upper link 8A. If desired, the upper link 8A may be welded to the upper end of the rearmost leg 5R of the first stage component and to the upper end of the foremost leg 6F of the second stage component.

Variations of Means for Facilitating the Movement of the Stage System

Figure 6A:
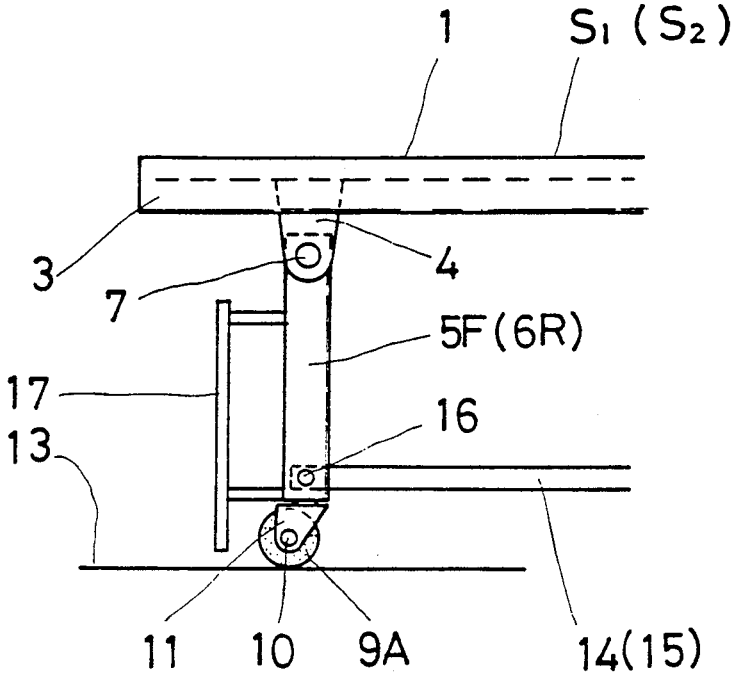
FIG. 6(*a*) shows a castor which may be connected to the lower end of each foremost leg of the first second stage component of the stage system of FIG. 1 or 4 or to the lower end of each rearmost leg of the second stage component thereof.
Figure 6B:
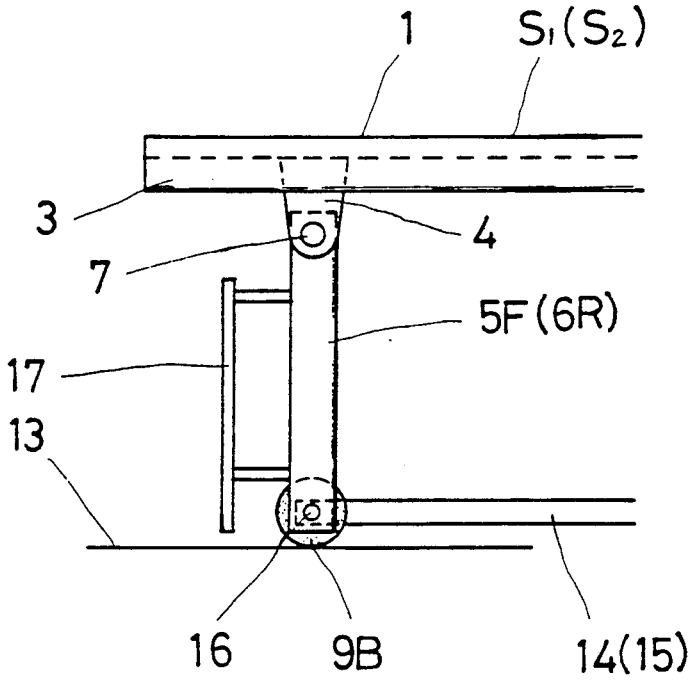

In the embodiment of FIGS. 1 and 2 the two wheels 9 are connected to the lower end of each of the foremost legs 5F of the first stage component and of the rearmost legs 6R of the second stage component, to facilitate the movement of the stage system on the floor. The wheels 9 only enable the stage components to move to the right and to the left in FIG. 1. If desired, as shown in FIG. 6(*a*), the two wheels 9 may be replaced with a single castor 9A to enable the stage system to move freely in desired directions. Also, if desired, only one wheel 9B may be used instead of the two wheels 9 (FIG. 6(*b*)).

Modifications of Means for Operating the Stage Components

Figure 7:
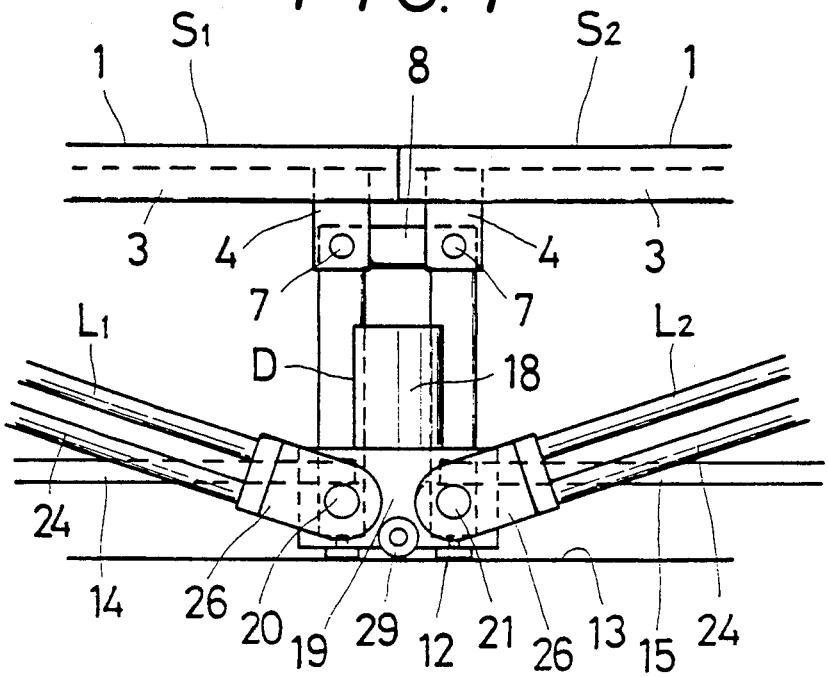
FIG. 7 shows a modification of an operating means used for the stage system of FIG. 1.

In the embodiment of FIGS. 1 and 2 the output shafts 20 and 21 projecting from the speed reducer 19 in opposite directions are used. However, if desired, two output shafts projecting from the same side of the speed reducer may be used for the connection thereto of the respective link means $L_1$ and $L_2$, as shown in FIG. 7.

One Variation of the Stage System

In the embodiment of FIGS. 1 and 2, the lengths of the link means $L_1$ and $L_2$ are reduced or increased as the stage system is unfolded or folded, so that the operating means D are allowed always to stay on the floor. However, if desired, unextensible link means of FIG. 3 may be used instead of the extensible and retractible link means of FIGS. 1 and 2. In this case, the operating means D are not allowed always to stay on the floor, but are lowered or raised as the stage system is unfolded or folded.

Another Variation of the Stage System

Figure 8A:
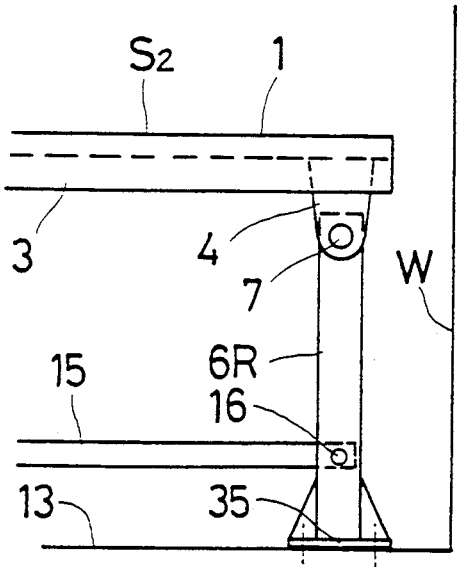
FIG. 8(*a*) shows means which may be used to fix the rearmost leg of the second stage component of the stage system of FIG. 1 on a floor.
Figure 8B:
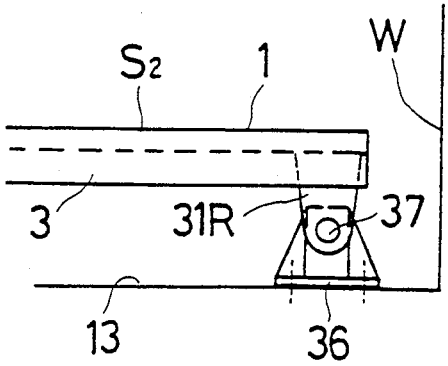

The stage system of FIGS. 1 and 2 are movable to a desired place where the stage system is to be unfolded o to be stored. However, if desired, the stage system of FIGS. 1 and 2 may be modified into a "fixed" type of stage system by omitting the wheels 9 from the second stage component and instead providing the lower end of each rearmost leg 6R of the second stage component with a fixing means 35 to be secured on the floor 13 (FIG. 8(*a*)). The rearmost legs 6R of the second stage component are fixed by securing the plates 35 on the floor 13. In this modification, the stage system is unfolded to the left of the fixed legs 6R (in FIG. 8(*a*)) and is folded toward the fixed legs 6R. In FIG. 8(*a*) the letter W designates a wall.

Low-type Stage System

Figure 4:
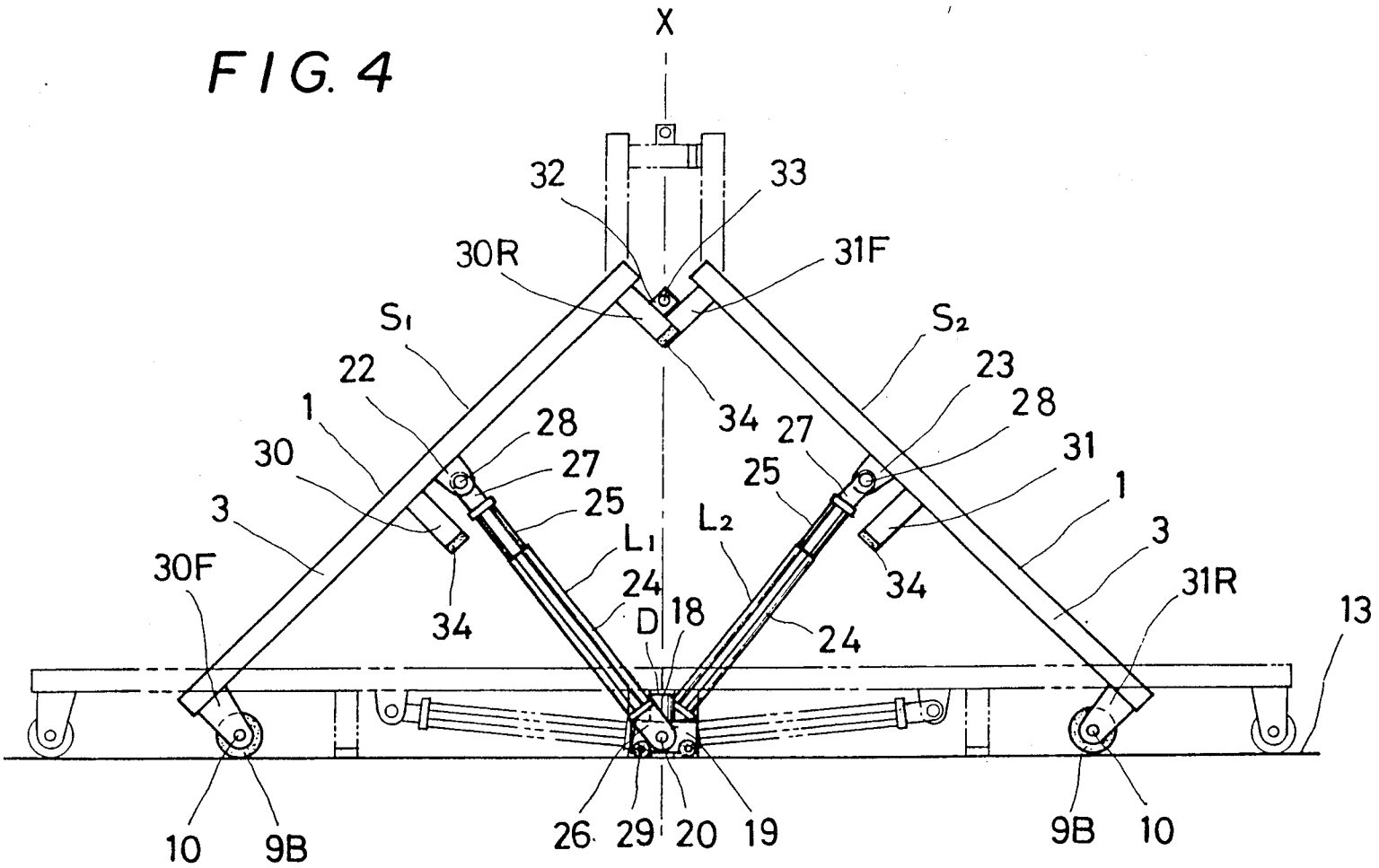
FIG. 4 is a side view of a low-type electrically-operated folding stage system according to the invention.

FIG. 4 depicts a preferred embodiment of a low-type electrically-operated folding stage system according to the invention. As with the stage system of FIGS. 1 and 2, the stage system of FIG. 4 includes a pair of first and second stage components $S_1$ and $S_2$. The first stage component includes plural rows of relatively short legs 30F, 30 and 30R fixed to the bottom of a platform 1 thereof. Similarly, the second stage component includes plural rows of relatively short legs 31F, 31 and 31R fixed to the bottom of a platform 1 thereof. A wheel 9B is connected to the lower end of each foremost leg 30F of the first stage component. Also, a wheel 9B is connected to the lower end of each rearmost leg 31R.

Reference numeral 32 designates a bracket projecting rearward from the rearmost leg 30R of the first stage component and connected to a bracket (not shown) projecting forward from the opposed foremost leg 31F of the second stage component by a pivotal pin 33. A pad 34 of hard rubber is connected to the bottom of each of the middle and rearmost legs 30 and 30R of the first stage component. Also, a pad 34 of hard rubber is connected to the bottom of each of the middle and foremost legs 31 and 31F of the second stage component. The pads 34 have such heights that, when the pads 34 are on a floor 13, the legs to which the pads 34 are connected have the same heights from the floor as the foremost legs of the first stage component and the rearmost legs of the second stage component. Thus, when the stage system is in the state of being unfolded, the platforms of the two stage components are on the same level.

Each leg of the first stage component is not aligned with, but is offset against, the leg of the second stage component which corresponds thereto when the stage system is in the state of being folded to a vertical position. Therefore, each leg of the first stage component is not in contact with the corresponding leg of the second stage component when the stage system is in the state of being folded.

Since the legs are fixed to the platforms, no beam corresponding to the beams 14 and 15 of the high-type stage system of FIGS. 1 and 2 is provided for the low-type stage system of FIG. 4.

In the other respects the low-type stage system of FIG. 4 is constructed similarly to the high-type stage system of FIGS. 1 and 2.

As with the high-type stage system, the extensible and retractible link means $L_1$ and $L_2$ of the low-type stage system may be replaced with unextensible link means.

Figure 3:
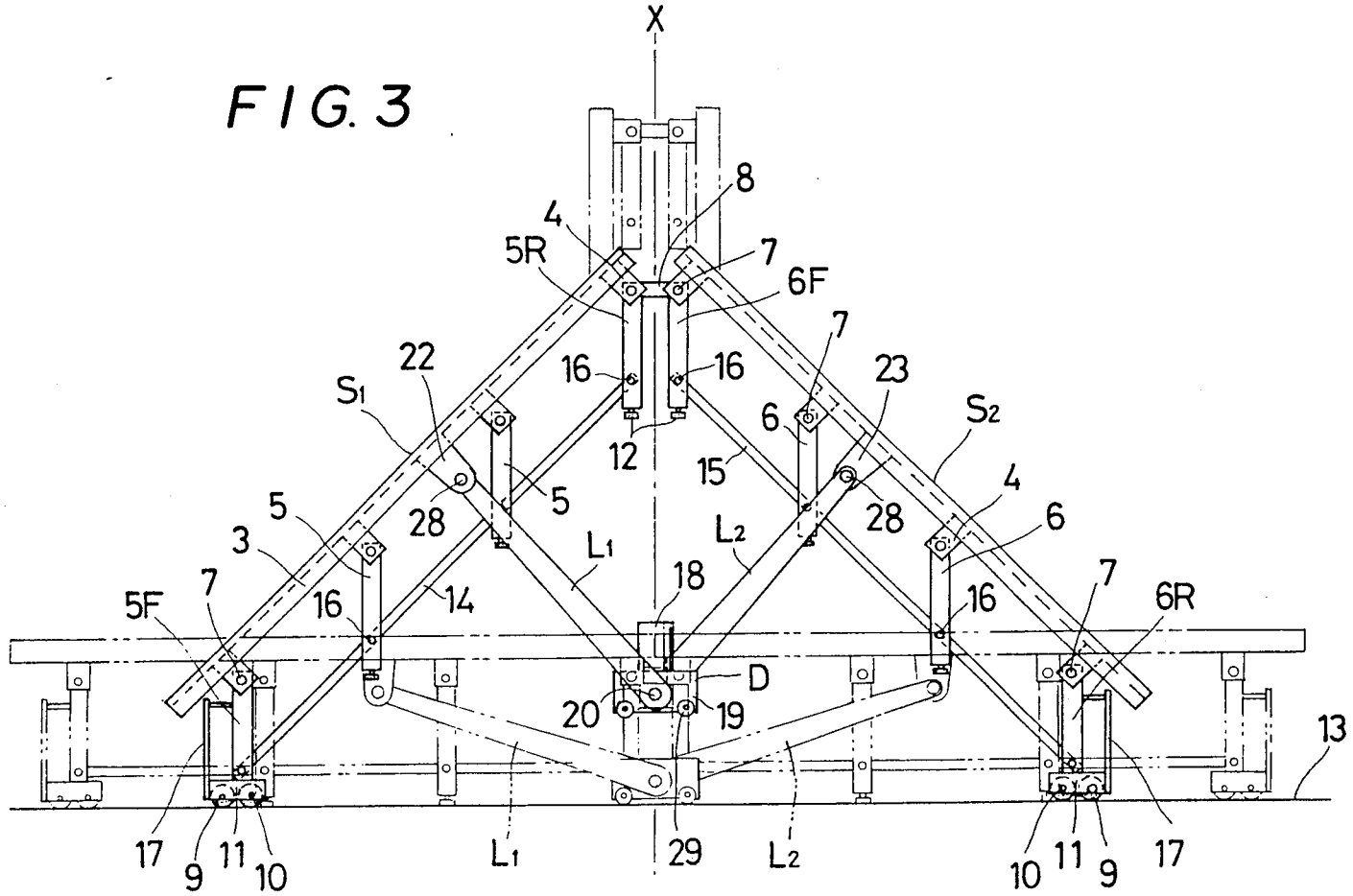
FIG. 3 is a modification of the stage system of FIG. 1.

Parts of FIG. 3 equivalent to those described in regard to FIGS. 1 and 2 are indicated by the same reference numerals.

Variation of the Low-type Stage System

The low-type stage system of FIG. 4 is movable to a desired place where the stage system is to be unfolded or to be stored. However, if desired, the low-type stage system of FIG. 4 may be modified into a "fixed" type of stage system by omitting the wheels 9B from the second stage component and instead pivotally connecting the lower end of each rearmost leg 31R of the second stage component, by means of a pin 37, to a fixing means 36 secured on the floor 13. In this variation, each rearmost leg 31R turns on the pivotal pin 37 as the stage system is folded or unfolded. In this variation, the stage system is unfolded to the left of the fixed legs 31R (in FIG. 8(*b*)) and is folded toward the fixed legs 31R.

Meritorious Effects of the Stage Systems

In contrast with the conventional stage system of the type having a guide post fixed to a wall, either stage system of the invention, namely, the high-type stage system or the low-type stage system, provides a sufficient stage depth even in a place with a floor-to-ceiling height of only 3 to 4 meters. Therefore, the stage system may be advantageously used, for example, in a schoolroom, a recreation room or an assembly room of a school or a kindergarten or in an assembly room, a council room or a grand hall of a hotel or the like. Also, since any portion of the system is not fixed, in use, to an external object either permanently or temporarily, the system may be freely moved to a desired place inside or outside a building and may be used there. Thus the system may be conveniently used either as an outdoor stage or as an indoor stage. Moreover, after the system has been compactly folded, it may be removed, e.g., to a space near a wall or into a storeroom, to clear the floor. Furthermore, the system is electrically or automatically unfolded or folded, the system is a labor-saving one.

What is claimed is:

1. An electrically-operated folding stage system comprising (a) a pair of first and second stage components connected to each other and each including a platform, (b) plural operating means each having a pair of output shafts and located directly below a borderline between the platforms of the stage components, (c) a first link means with a lower end fixed to one of the output shafts, (d) a second link means with a lower end fixed to the other output shaft, (e) means for pivotally connecting an upper end of the first link means to a bottom of the platform of the first stage component, (f) means for pivotally connecting an upper end of the second link means to the bottom of the platform of the second stage component, (g) the platforms of the first and second stage components providing a single continuous surface when the first and second stage components are in horizontal positions on a floor, and (h) the first and second link means making arcing motions, when the operating means are operated, so that the first link means causes the first stage component to move from the horizontal position to a first vertical position while the second link means causes the second stage component to move from the horizontal position to a second vertical position which faces the first vertical position.

2. A stage system in accordance with claim 1 wherein each of the link means includes a pair of integrally formed tubes and a pair of rods slidably disposed in the respective tubes so that the rods may be extended from the respective tubes or retracted thereinto as the stage system is unfolded and unfolded, thereby changing a distance between the output shaft to which the lower end of the link means is fixed and the means for pivotally connecting the upper end of the link means to the platform.

3. A stage system in accordance with claim 1 wherein each of the link means includes no extensible member.

4. A stage system of claim 1 further including means which enable the operating means at least in two opposite directions on the floor.

5. A stage system in accordance with claim 4 wherein each of the link means includes a pair of integrally formed tubes and a pair of rods slidably disposed in the respective tubes so that the rods may be extended from the respective tubes or retracted thereinto as the stage system is unfolded and unfolded, thereby changing a distance between the output shaft to which the lower end of the link means is fixed and the means for pivotally connecting the upper end of the link means to the platform.

6. A stage system in accordance with claim 4 wherein each of the link means includes no extensible member.

7. A high-type electrically-operated folding stage system comprising (a) a pair of first and second stage components connected to each other and each having (i) a platform, (ii) plural rows of brackets fixed to a bottom thereof, (iii) legs pivotally connected to the respective brackets at upper ends thereof, (iv) a beam located in parallel with an outer row of the legs and extending along a line connecting lower ends of the legs of the outer row, (v) a beam located in parallel with an opposed outer row of the legs and extending along a line connecting lower ends of the legs of the opposed outer row, (vi) a pair of beams located in parallel with a central row of the legs on opposed sides of the central row of the legs and extending along a line connecting lower ends of the legs of the central row, and (vii) rods arranged in directions perpendicular to the beams and each extending through corresponding legs of the rows of the legs and the beams, said beams being capable of turning on said rods, (b) means connected to lower ends of foremost legs of the first stage component and to lower ends of rearmost legs of the second stage component for allowing the stage components to be moved at least in two opposite directions on a floor, (c) plural operating means each having a pair of output shafts and located directly below a borderline between the platforms of the stage components, (d) means for allowing the operating means to be moved at least in two opposite directions on the floor, (e) a first link means with a lower end fixed to one of the output shafts, (f) a second link means with a lower end fixed to the other output shaft, (g) means for pivotally connecting an upper end of the first link means to the bottom of the platform of the first stage component, (h) means for pivotally connecting an upper end of the second link means to the bottom of the platform of the second stage component, (i) the platforms of the first and second stage components providing a single continuous surface when the first and second stage components are in horizontal positions on the floor, and (j) the first and second link means making arcing motions, when the operating means are operated, so that the first link means causes the first stage component to move from the horizontal position to a first vertical position while the second link means causes the second stage component to move from the horizontal position to a second vertical position which faces the first vertical position.

8. A stage system in accordance with claim 7 wherein each of the link means includes a pair of integrally formed tubes and a pair of rods slidably disposed in the respective tubes so that the rods may be extended from the respective tubes or retracted thereinto as the stage system is unfolded and unfolded, thereby changing a distance between the output shaft to which the lower end of the link means is fixed and the means for pivotally connecting the upper end of the link means to the platform.

9. A high-type electrically-operated folding stage system comprising (a) a pair of first and second stage components connected to each other and each having (i) a platform, (ii) plural rows of brackets fixed to a bottom thereof, (iii) legs pivotally connected to the respective brackets at upper ends thereof, (iv) a beam located in parallel with an outer row of the legs and extending along a line connecting lower ends of the legs of the outer row, (v) a beam located in parallel with an opposed outer row of the legs and extending along a line connecting lower ends of the legs of the opposed outer row, (vi) a pair of beams located in parallel with a central row of the legs on opposed sides of the central row of the legs and extending along a line connecting lower ends of the legs of the central row, and (vii) rods arranged in directions perpendicular to the beams and each extending through corresponding legs of the rows of the legs and the beams, said beams being capable of turning on said rods, (b) means connected to lower ends of foremost legs of the first stage component for allowing the foremost legs of the first stage component to be moved at least in two opposite directions on a floor, (c) means for fixing lower ends of rearmost legs of the second stage component onto the floor, (d) plural operating means each having a pair of output shafts and located directly below a borderline between the platforms of the stage components, (e) means for allowing the operating means to be moved at least in two opposite directions on the floor, (f) a first link means with a lower end fixed to one of the output shafts, (g) a second link means with a lower end fixed to the other output shaft, (h) means for pivotally connecting an upper end of the first link means to the bottom of the platform of the first stage component, (i) means for pivotally connecting an upper end of the second link means to the bottom of the platform of the second stage component, (j) the platforms of the first and second stage components providing a single continuous surface when the first and second stage components are in horizontal positions on the floor, and (k) the first and second link means making arcing motions, when the operating means are operated, so that the first link means causes the first stage component to move from the horizontal position to a first vertical position while the second link means causes the second stage component to move from the horizontal position to a second vertical position which faces the first vertical position.

10. A stage system in accordance with claim 9 wherein each of the link means includes a pair of integrally formed tubes and a pair of rods slidably disposed in the respective tubes so that the rods may be extended from the respective tubes or retracted thereinto as the stage system is unfolded and unfolded, thereby changing a distance between the output shaft to which the lower end of the link means is fixed and the means for pivotally connecting the upper end of the link means to the platform.

11. A low-type electrically-operated folding stage system comprising (a) a pair of first and second stage components connected to each other and each including a platform and plural legs fixed to a bottom of the platform, (b) means connected to lower ends of foremost legs of the first stage component and to lower ends of rearmost legs of the second stage component for allowing the stage components to be moved at least in two opposite directions, (c) plural operating means each having a pair of output shafts and located directly below a borderline between the platforms of the stage components, (d) means for allowing the operating means to be moved at least in two opposite directions on the floor, (e) a first link means with a lower end fixed to one of the output shafts, (f) a second link means with a lower end fixed to the other output shaft, (g) means for pivotally connecting an upper end of the first link means to the bottom of the platform of the first stage component, (h) means for pivotally connecting an upper end of the second link means to the bottom of the platform of the second stage component, (i) the platforms of the first and second stage components providing a single continuous surface when the first and second stage components are in horizontal positions on a floor, and (j) the first and second link means making arcing motions, when the operating means are operated, so that the first link means causes the first stage component to move from the horizontal position to a first vertical position while the second link means causes the second stage component to move from the horizontal position to a second vertical position faces the first vertical position.

12. A stage system in accordance with claim 11 wherein each of the link means includes a pair of integrally formed tubes and a pair of rods slidably disposed in the respective tubes so that the rods may be extended from the respective tubes or retracted thereinto as the stage system is unfolded and unfolded, thereby changing a distance between the output shaft to which the lower end of the link means is fixed and the means for pivotally connecting the upper end of the link means to the platform.

13. A low-type electrically-operated folding stage system comprising (a) a pair of first and second stage components connected to each other and each including a platform and plural legs fixed to a bottom of the platform, (b) means connected to lower ends of foremost legs of the first stage component for allowing the foremost legs of the first stage component to be moved at least in two opposite directions, (c) fixing means fixed on a floor, (d) means for pivotally connecting lower ends of rearmost legs of the second stage component to the fixing means, (e) plural operating means each having a pair of output shafts and located directly below a borderline between the platforms of the stage components, (f) means for allowing the operating means to be moved at least in two opposite directions on the floor, (g) a first link means with a lower end fixed to one of the output shafts, (h) a second link means with a lower end fixed to the other output shaft, (i) means for pivotally connecting an upper end of the first link means to the bottom of the platform of the first stage component, (j) means for pivotally connecting an upper end of the second link means to the bottom of the platform of the second stage component, (k) the platforms of the first and second stage components providing a single continuous surface when the first and second stage components are in horizontal positions on the floor, and (l) the first and second link means making arcing motions, when the operating means are operated, so that the first link means causes the first stage component to move from the horizontal position to a first vertical position while the second link means causes the second stage component to move from the horizontal position to a second vertical position which faces the first vertical position.

14. A stage system in accordance with claim 13 wherein each of the link means includes a pair of integrally formed tubes and a pair of rods slidably disposed in the respective tubes so that the rods may be extended from the respective tubes or retracted thereinto as the stage system is unfolded and unfolded, thereby changing a distance between the output shaft to which the lower end of the link means is fixed and the means for pivotally connecting the upper end of the link means to the platform.

* * * * *